US006892408B2

(12) United States Patent
Goddard et al.

(10) Patent No.: US 6,892,408 B2
(45) Date of Patent: May 17, 2005

(54) LAUNDRY APPLIANCE

(75) Inventors: Guy Austin Goddard, Swindon (GB); Malcolm John Hird, Abergavenny (GB); David Ions, Shrivenham (GB)

(73) Assignee: Dyson Limited, Wiltshire (GB)

( * ) Notice: Subject to any disclaimer, the term of this patent is extended or adjusted under 35 U.S.C. 154(b) by 150 days.

(21) Appl. No.: 10/380,118

(22) PCT Filed: Sep. 27, 2001

(86) PCT No.: PCT/GB01/04324

§ 371 (c)(1),
(2), (4) Date: Mar. 11, 2003

(87) PCT Pub. No.: WO02/33159

PCT Pub. Date: Apr. 25, 2002

(65) Prior Publication Data

US 2004/0019977 A1 Feb. 5, 2004

(30) Foreign Application Priority Data

Oct. 17, 2000 (GB) ..... 0025422

(51) Int. Cl.[7] ..... D06F 39/04
(52) U.S. Cl. ..... 8/158; 8/158; 68/24; 68/15
(58) Field of Search ..... 68/24, 27, 58, 68/140, 143, 145, 142, 15; 8/158, 159

(56) References Cited

U.S. PATENT DOCUMENTS 2,095,505 A * 10/1937 Kirby ..... 68/23.6
2,516,656 A * 7/1950 Smith ..... 68/131
2,575,691 A * 11/1951 Smith ..... 68/23.7
2,630,001 A * 3/1953 Criner ..... 68/23.5
3,952,557 A * 4/1976 Bochan ..... 68/23.3
4,020,659 A * 5/1977 Bhavsar ..... 68/27
4,156,358 A * 5/1979 Harrsch ..... 68/27
D272,668 S * 2/1984 Percival et al. ..... D32/29
4,742,698 A * 5/1988 Torita ..... 68/12.04
5,025,645 A * 6/1991 Eck et al. ..... 68/27
5,231,857 A * 8/1993 Rew et al. ..... 68/134
6,311,627 B1 * 11/2001 Draper et al. ..... 108/50.11
6,497,123 B2 * 12/2002 Monteiro et al. ..... 68/140

FOREIGN PATENT DOCUMENTS

| | | |
|---|---|---|
| EP | 0 742 307 A1 | 11/1996 |
| GB | 2 043 954 | 10/1980 |
| GB | 2 337 274 | 11/1999 |
| JP | 02224696 | 9/1990 |

* cited by examiner

*Primary Examiner*—Frankie L. Stinson
(74) *Attorney, Agent, or Firm*—Morrison & Foerster LLP

(57) ABSTRACT

The invention provides a method of operating a laundry appliance (10) comprising an outer casing (12) and a drum (50) rotatably mounted within the outer casing (12), the drum (50) having at least two rotatable portions (60, 70) which are capable of being rotated in either a synchronized mode or a non-synchronized mode, the method comprising the steps of: (a) introducing water to the interior of the drum (50); (b) heating the water to a desired temperature; (c) rotating the drum (50) to effect a washing action; and (d) spinning the drum (50) at a relatively high speed so as to remove water therefrom. In one aspect, the drum (50) is rotated in the non-synchronized mode either during or immediately after the step of introducing water to the interior of the drum (50). This helps to distribute the washing liquid throughout the wash load. In a second aspect, the drum (50) is rotated in the synchronized mode during a first part of step (c) and in the non-synchronized mode during a second part of step (c), the average temperature of the water being no less during the second part of step (c) than the average temperature of the water during the first part of step (c). This improves the efficacy of the period of non-synchronized rotation. In a third aspect, the drum (50) is rotated in the non-synchronized mode after the end of stop (d). This releases the wash load from the drum walls after spinning and minimises creasing.

25 Claims, 5 Drawing Sheets

LAUNDRY APPLIANCE

Figure 1:
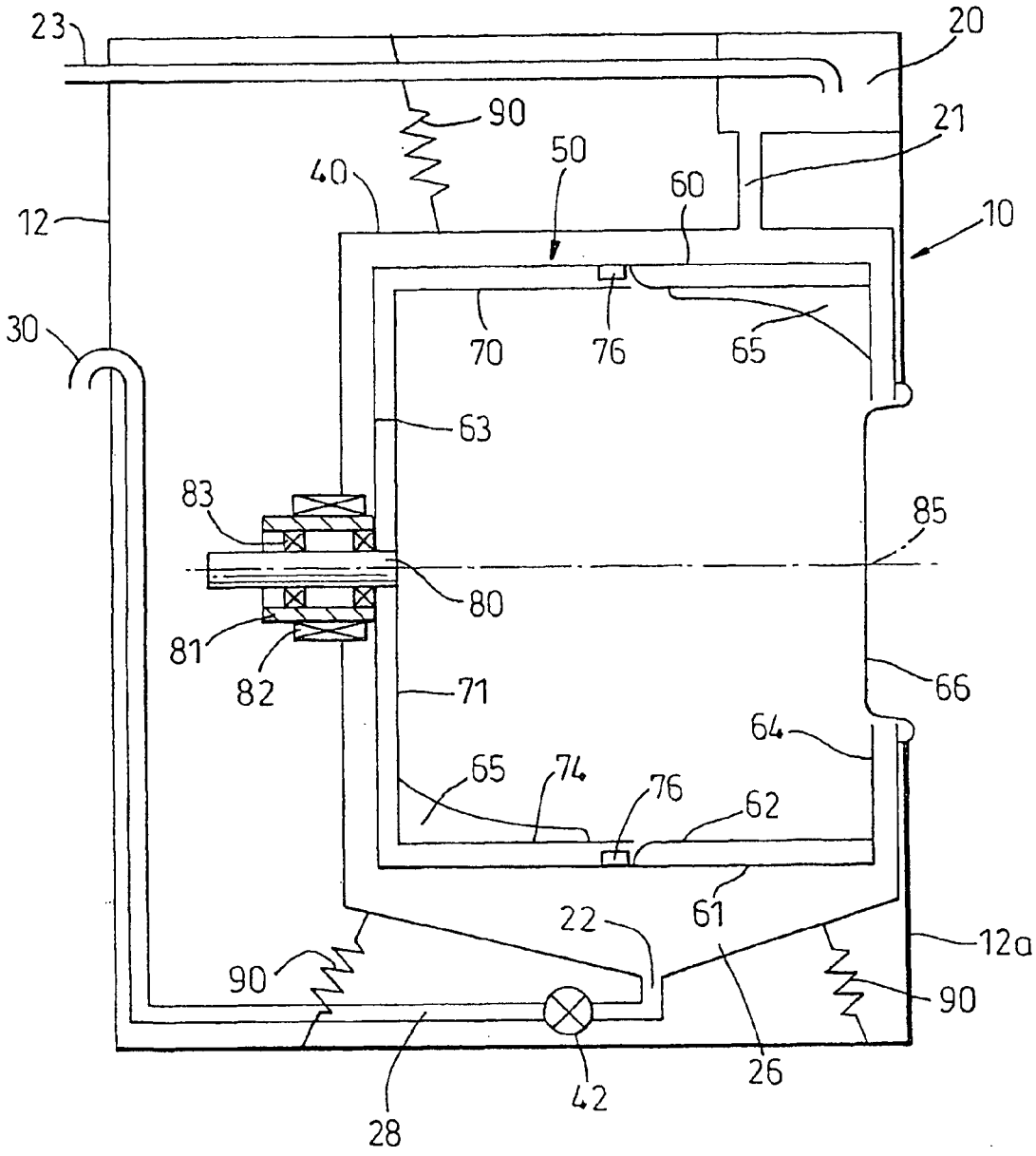

The invention relates to a method of operating a laundry appliance and to a laundry appliance programmed to operate in a particular manner. Particularly, the invention relates to a method of operating a washing machine or washer-dryer. The invention is applicable in both domestic and commercial environments.

Washing machines and their methods of operation are common knowledge. In summary, a washing machine comprises a housing containing a watertight tub in which a perforated drum is rotatably mounted. The articles to be washed are placed in the drum and water is introduced thereto so as thoroughly to wet them. The temperature of the water is raised to the desired temperature for washing and a wash action is carried out. In the case of front-loading machines, this is achieved by slow rotation of the drum to lift the articles and drop them into the residual water in the drum. In the case of top-loading machines, a rotator paddle is used to agitate the articles inside the drum. When the washing action is complete, the water is drained, fresh water is added to rinse the articles and the drum is then spun at high speed to extract the water in a centrifugal manner. Rinsing and spinning can be repeated up to three or more times.

A washing machine having a drum comprising at least two rotatable portions is described in WO99/58753. This machine operates in a manner which allows the rotatable portions to rotate in a non-synchronized mode in which the rotatable portions rotate at different speeds and/or in different directions with respect to one another. The washing action achieved by this arrangement is superior to the washing action achieved by other known machines.

Further research has shown that the stage of the washing cycle during which the non-synchronized mode is used has beneficial effects to the operation of the machine as a whole.

It is therefore an object of the present invention to provide a method of operating a laundry appliance of the type described in WO99/58753 in which the overall efficiency of the appliance is improved. It is a further object of the invention to provide a method of operating a laundry appliance of the said type in which the speed with which the articles to be washed are wetted is reduced. It is a still further object of the invention to provide a method of operating a laundry appliance of the said type in which the efficacy of the non-synchronized portion of the wash cycle is maximised. It is a yet further object of the invention to provide a laundry appliance of the said type in which the washed articles are more readily removed from the appliance after the washing cycle has been completed.

In a first aspect, the invention provides a method of operating a laundry appliance comprising an outer casing and a drum rotatably mounted within the outer casing, the drum having at least two rotatable portions which are capable of being rotated in either a synchronized mode or a non-synchronized mode, the method comprising the steps of:

(a) introducing water to the interior of the drum;
(b) heating the water to a desired temperature;
(c) rotating the drum to effect a washing action; and
(d) spinning the drum at a relatively high speed so as to remove water therefrom;

wherein the drum is rotated in the non-synchronized mode either during or immediately after the step of introducing water to the interior of the drum.

The use of non-synchronized rotation during or immediately after the introduction of water to the interior of the drum assists with the thorough wetting of the articles to be washed in that the articles are rearranged inside the drum. Articles near the drum wall which are well wetted are moved to the center of the drum and replaced by less well wetted articles which may previously have been located near the center of the drum. If the heating of the water to the desired temperature has also been commenced when the non-synchronized rotation starts, then an even temperature distribution will be achieved in a comparatively short space of time. This is beneficial in that the temperature will be less likely to fluctuate during the washing cycle.

In a second aspect, the invention provides a method of operating a laundry appliance comprising an outer casing and a drum rotatably mounted within the outer casing, the drum having at least two rotatable portions which are capable of being rotated in either a synchronized mode or a non-synchronized mode, the method comprising the steps of:

(a) introducing water to the interior of the drum;
(b) heating the water to a desired temperature;
(c) rotating the drum to effect a washing action; and
(d) spinning the drum at a relatively high speed so as to remove water therefrom;

wherein the drum is rotated in the synchronized mode during a first part of step (c) and in the non-synchronized mode during a second part of step (c), the temperature of the water being no less during the second part of step (c) than the temperature of the water during the first part of step (c).

It has been found that the efficacy of the non-synchronized rotation mode is improved if the temperature of the water during non-synchronized rotation is at or near the desired temperature of the water for the washing cycle. Thus, if the drum is to rotate in a synchronized mode and a non-synchronized mode at different times, it is beneficial for the non-synchronized mode to follow the synchronized mode as the temperature increases. Alternatively, it is beneficial for the non-synchronized mode of rotation to occur when the water has achieved the desired temperature.

In a third aspect, the invention provides a method of operating a laundry appliance comprising an outer casing and a drum rotatably mounted within the outer casing, the drum having at least two rotatable portions which are capable of being rotated in either a synchronized mode or a non-synchronized mode, the method comprising the steps of:

(a) introducing water to the interior of the drum;
(b) heating the water to a desired temperature;
(c) rotating the drum to effect a washing action; and
(d) spinning the drum at a relatively high speed so as to remove water therefrom;

wherein the drum is rotated in the non-synchronized mode after the end of step (d).

It will be appreciated that, at the end of a known washing cycle, the articles which have been washed are frequently stuck to the sides of the drum. The articles can then become creased if they are not immediately removed from the appliance. If the drum is rotated in the non-synchronous mode after the final spin has occurred, the articles are released from the walls of the drum and allowed to fall loosely to the bottom thereof. Less creasing is thus likely.

Further advantageous and preferable features relating to each aspect of the invention are set out in the subsidiary claims.

Figure 2A:
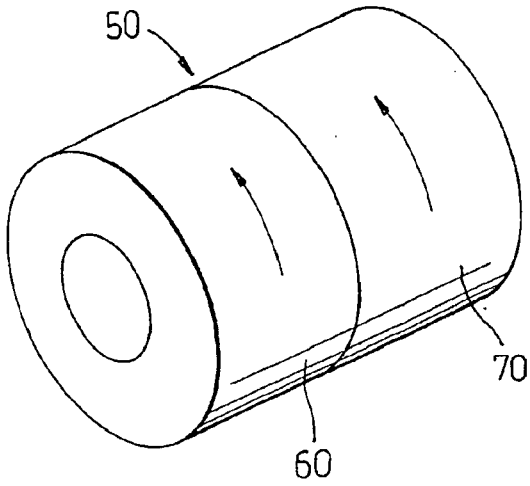
Figure 2B:
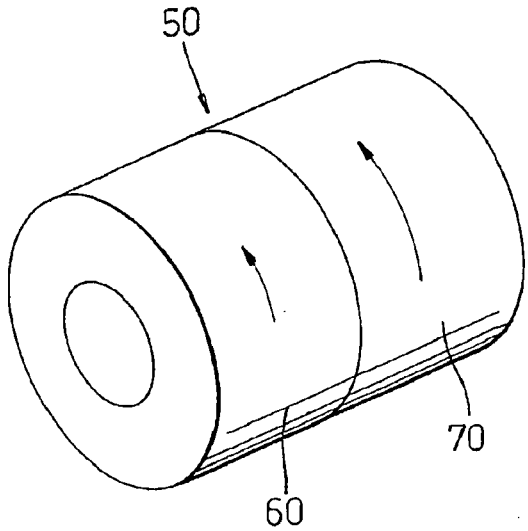
Figure 2C:
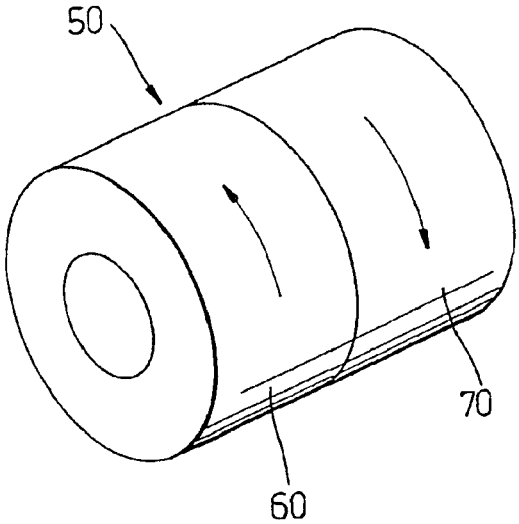
Figure 2D:
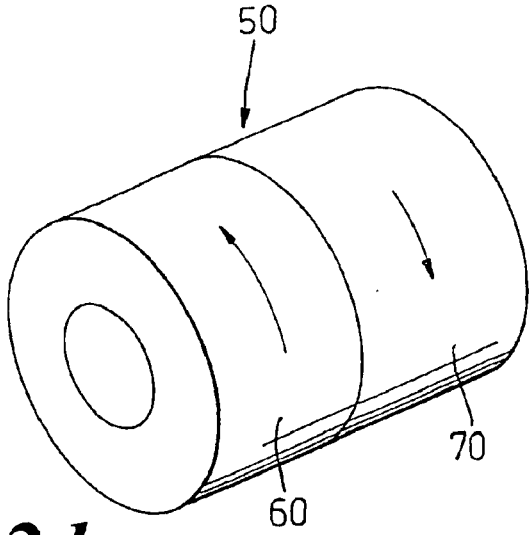
Figure 3A:
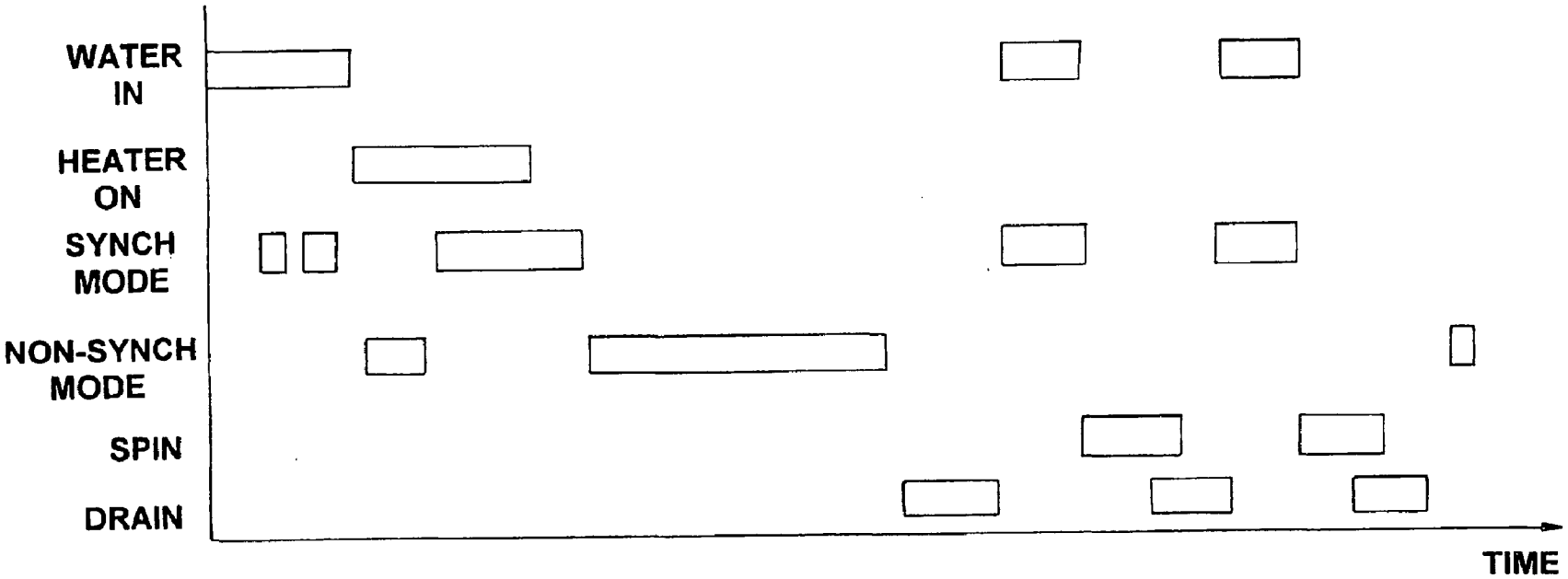
Figure 3B:
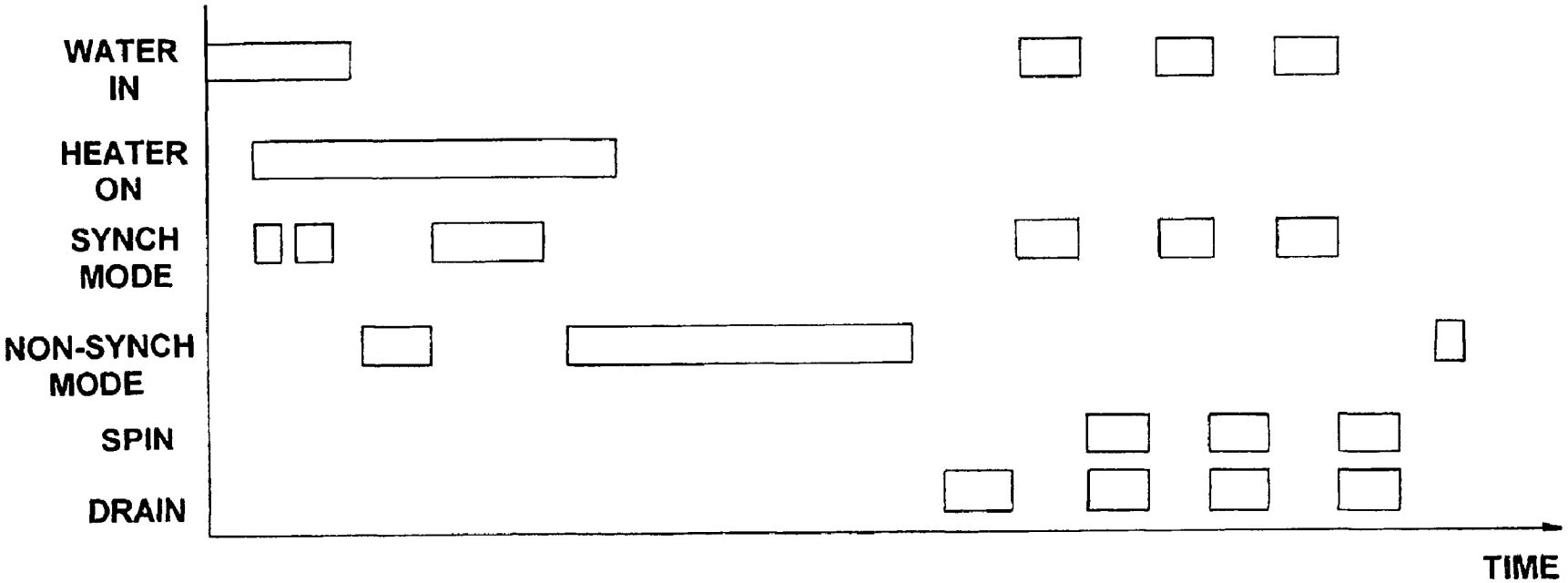
Figure 3C:
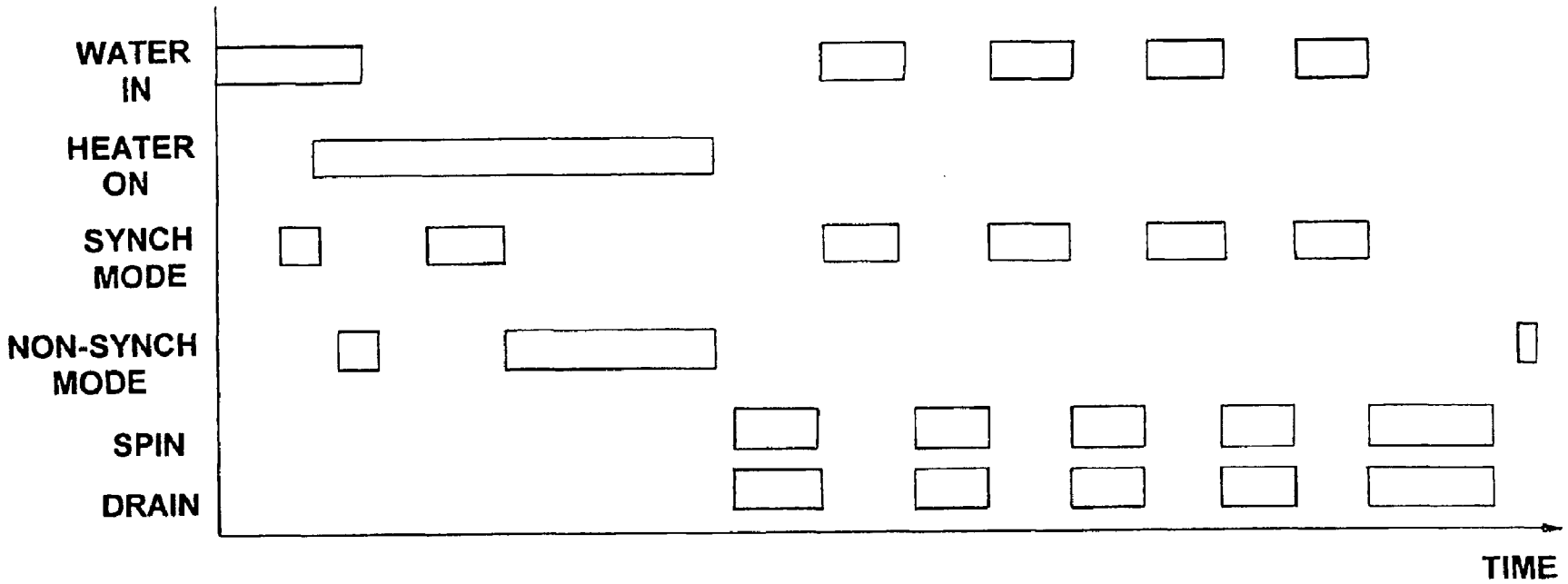

Embodiments of the invention will now be described with reference to the accompanying drawings, wherein:

FIG. 1 is a sectional side view of a washing machine of the type described in WO99/58753 and programmed so as to operate in accordance with a method according to the invention;

FIGS. 2*a*–2*d* are schematic illustrations of the drum of the washing machine of FIG. 1 illustrating various modes of rotation thereof; and FIGS. 3*a*–3*c* are schematic illustrations of specific wash cycles which can be performed by the washing machine of FIG. 1.

FIG. 1 shows a washing machine 10 which includes an outer casing 12 in which a tub 40 is located and supported by spring-damper devices 90. A drum 50 is mounted inside the tub 40 so as to be rotatable about an axis 85. The tub 40 is watertight except for an inlet 21 and an outlet 22. The washing machine 10 includes a soap tray 20 capable of receiving and delivering detergent in a known manner. At least one water inlet 23 communicates with the soap tray 20 and is provided with suitable means for connection to a water supply within the environment in which the washing machine 10 is to be used. A conduit 21 is provided between the soap tray 20 and the tub 40 so as to allow water introduced via the inlet 23 to enter the tub 40 carrying detergent with it. The tub 40 has a sump 26 located beneath the drum 50. A drainage pipe 28 communicates with the sump 26 and leads to an outlet 30 via which wash liquor can be discharged from the washing machine 10. A pump 42 is provided to allow wash liquor to be pumped from the sump 26 to the outlet 30 at appropriate stages of the washing cycle carried out by the washing machine 10.

The drum 50 is rotatably mounted about the axis 85 by way of a shaft 80. The shaft 80 is mounted in a known manner, allowing the tub 40 to remain stationary whilst the drum 50 is rotatable with the shaft 80. The shaft 80 is rotatably driven by a motor (not shown) mounted within the outer casing 12 of the washing machine 10. A door 66 is located in the front panel 12*a* of the outer casing 12 to allow access to the interior of the drum 50. It is via the door 66 that a wash load can be deposited within the drum 50 before a wash cycle commences and removed from the drum 50 at the end of the wash cycle.

Drum 50 comprises two rotatable portions 60, 70 which are mounted such that they can be rotated with respect to one another. A drum of this type is described more fully in International Patent Application WO99/58753. Typically the drum portions 60, 70 are rotated in directions opposite to one another, i.e. one portion is rotated clockwise whilst the other is rotated counter-clockwise, but they can also be rotated together in the same direction. FIG. 2 illustrates several different modes of operation of the drum portions 60, 70.

FIG. 2*a* illustrates synchronized rotation in which both of the rotatable portions 60, 70 rotate in the same direction and at the same speed. Each of FIGS. 2*b*, 2*c* and 2*d* illustrate non-synchronized modes of operation. In FIG. 2*b*, both rotatable portions rotate in the same direction but one of the rotatable portions 60 rotates at a slower speed than the other rotatable portion 70. In the mode illustrated in FIG. 2*c*, the rotatable portions rotate at the same speed but in different directions. In the mode illustrated in FIG. 2*d*, the rotatable portions rotate in opposite directions and at different speeds, with the first rotatable portion 60 rotating at a higher speed than that of the second rotatable portion 70. It must be emphasised that all three of the modes illustrated in FIGS. 2*b*, 2*c* and 2*d* are to be regarded as non-synchronous modes and that, when the rotatable portions are made to rotate at different speeds, the difference between those speeds is not critical. What is critical is that one rotatable portion rotates with respect to the other rotatable portion. The means by which the modes of operation are achieved are not critical either. One means of achieving the different modes is described in detail in WO99/58753. Other means of achieving the relevant speeds and directions of rotation will be apparent to a skilled reader.

The drum 50 is mounted in a cantilever fashion on the wall of the tub 40 remote from the door 66. The outer rotatable portion 60 is supported on a hollow cylindrical shaft 81. An angular contact bearing 82 is located between the rear wall of the tub 40 and the hollow cylindrical shaft 81. The outer rotatable portion 60 is dimensioned so as substantially to fill the interior of the tub 40. More specifically, the outer rotatable portion 60 has a generally circular rear wall 63 extending from the hollow cylindrical shaft 81 towards the cylindrical wall of the tub 40, a generally cylindrical wall 61 extending generally parallel to the cylindrical walls of the tub 40 from the rear wall 63 towards the front wall of the tub 40, and a generally annular front face 64 extending from the cylindrical wall 61 towards the door 66. Sufficient clearance is allowed between the walls 61, 63, 64 of the outer rotatable portion 60 and the tub 40 to prevent the outer rotatable portion 60 from coming into contact with the tub 40 when the drum 50 is made to spin.

An inner cylindrical wall 62 is also provided on the interior of the cylindrical wall 61 of the outer rotatable portion 60. The inner cylindrical wall 62 extends from a point which is substantially midway between the rear wall 63 and the front face 64 to the front face 64. The space between the interior cylindrical wall 62 and the cylindrical wall 61 is hollow but, if desired, could be filled with a strengthening material. In this event, the strengthening material must be lightweight. The provision of parallel cylindrical walls 61, 62 in the portion of the outer rotatable portion 60 closest to the front face 64 provides strength to the whole of the outer rotatable portion 60 whilst reducing the internal diameter of the outer rotatable portion 60 in this region.

The inner rotatable portion 70 is supported on a central shaft 80 which, in turn, is supported by deep groove bearings 83 located between the central shaft 80 and the hollow cylindrical shaft 81. The inner rotatable portion 70 essentially comprises a generally circular rear wall 71 extending from the central shaft 80 towards the cylindrical wall of the tub 40, and a cylindrical wall 74 extending from the periphery of the rear wall 71 towards the front wall of the tub 40. The diameter of the cylindrical wall 74 of the inner rotatable portion 70 is substantially the same as the diameter of the inner cylindrical wall 62 of the outer rotatable portion 60. The cylindrical wall 74 of the inner rotatable portion 70 is dimensioned so that its distal end approaches the end of the cylindrical wall 62 closest to it. It is advantageous to keep the gap between these two cylindrical walls 62, 74 as small as possible. An annular sealing ring 76 is located on the cylindrical wall 61 of the outer cylindrical portion 60 immediately adjacent the end of the inner cylindrical wall 62 closest to the inner cylindrical portion 70 so as to provide support for the distal end of the cylindrical wall 76 thereof.

Having described the apparatus by means of which the methods according to the invention can be carried out, the methods will now be described in detail.

FIGS. 3*a*, 3*b* and 3*c* are time charts (not to scale) which illustrate the order of various steps carried out during the washing machine cycle. The steps noted on the time charts are: the introduction of wash liquor or water to the interior of the tub and drum; the operation of a heater to heat the wash liquor in the tub and drum; rotation of the drum in a synchronized mode (as described above); rotation of the drum in a non-synchronized mode (as described above); spinning of the drum (which must be in synchronized mode; and draining of water or wash liquor from the sump of the tub. It is not intended that the scale of the time axis will be particularly accurate and no inference should be drawn as to the exact duration of each step from the relative lengths of each bar appearing on the charts. However, a general approximation of relative durations can be inferred. It is also to be understood that the precise means by which the required water level and temperature is maintained will not be described in any detail and that "top-up" activations of the water inlet means and the heating means may take place after the completion of the relevant steps illustrated without departing from the scope of the invention.

The first method illustrated is shown in FIG. 3*a*. As can be seen, the first step in the method is the introduction of wash liquor to the interior of the tub and drum. This step causes the articles contained within the drum to be wetted. Wash liquor will continue to be introduced until the articles have been completely saturated by wash liquor and a residual level has been achieved. During the step of introducing wash liquor to the tub/drum, a first short period of synchronized rotation will take place to help with the wetting of the articles and uniform distribution of detergent. Towards the end of the wash liquor introduction step, a second period of synchronized rotation takes place. This step lasts for a period of substantially 5 minutes.

Immediately after the end of the wash liquor introduction step, and after the second period of synchronized rotation, the drum is made to rotate in the non-synchronous mode. Any of the variations of the non-synchronous mode described above are usable here, although it is preferred that the rotatable portions are caused to rotate at the same speed in opposite directions (as illustrated in FIG. 2*c*). This period of non-synchronous rotation lasts for substantially 3 minutes and, in this embodiment, commences after the end of the period of wash liquor introduction. The inclusion of this step enhances the even distribution of water and detergent throughout the articles to be washed. The benefit is believed to come from the likelihood of articles previously located near the center of the drum being moved towards the wall of the drum so as to be more directly exposed to the wash liquor located in the tub.

Simultaneously with the start of the step of non-synchronized rotation, heating of the wash liquor which has been introduced to the tub/drum commences. The heating step commences in this embodiment after the wash liquor introduction step has been completed. Heating continues until the wash liquor reaches the temperature which has been selected, normally by the user, for the particular cycle to be carried out. Before the wash liquor reaches the desired temperature, a step of synchronized rotation commences. This step of synchronized rotation effects a washing action on the articles to be washed. It continues for a period of time which varies according to the program selected by the user. A typical duration for this step is between 5 and 15 minutes, although a longer period, even up to 35 or 40 minutes, is also possible. This step occurs whilst the wash liquor heating step is still in progress. Hence the temperature of the wash liquor increases with time during the step. At the end of the step, the temperature of the wash liquor is higher than the average temperature of the wash liquor during the whole of the step. In the embodiment shown in FIG. 3*a*, the desired temperature of the wash liquor is reached shortly before the end of this step of synchronized rotation.

Following the step of synchronized rotation described above, the drum is subsequently rotated in a non-synchronized mode in order to effect a washing action on the articles contained within the drum. Again, any of the various non-synchronous modes are possible and appropriate. The drum is rotated in this mode for a period of time which exceeds the duration of the previous step, preferably by two or three times. Hence the duration of the non-synchronous rotation step is preferably between 15 and 45 minutes. During the whole of this step, the temperature of the wash liquor remains at (or very near) the desired temperature. Hence the average temperature of the wash liquor during the non-synchronized step exceeds that during the previous synchronized step. It has been found by experimentation that non-synchronized rotation has greater cleaning ability when it occurs at higher temperatures than when it occurs at lower temperatures.

At the end of the period of non-synchronized rotation, the washing action is complete. The wash liquor is then drained from the tub/drum and, as is common, rinsing water is introduced to the tub/drum. The drum is rotated in synchronized mode to rinse the articles and the drum is then made to spin to extract the rinse water. The drain is opened to extract the rinse water before a second volume of rinse water is introduced and the rinse process is repeated.

Once the second volume of rinse water has been drained, the cycle is essentially complete. In known machines, the cycle would stop and the articles would be removed by the user. However, as has been mentioned, the final spin can cause the articles to be pressed very firmly against the walls of the drum and, in many cases, the articles remain so pressed until the user forcibly removes them. This causes unnecessary creasing. In the method according to the invention, the drum is caused to rotate in a non-synchronized mode for a very short period of time, less than 1 minute, after the final spin has taken place. This loosens the articles and causes them to fall away from the walls of the drum. The articles are then able to collect in a free manner in the bottom of the drum so that creasing is kept to a minimum. A final step, not shown, of synchronized rotation can be carried out if desired at the end of the cycle.

A second embodiment of the invention is illustrated in FIG. 3*b*. The method is similar to that shown in and described in relation to FIG. 3*a*. The essential differences are now described. Firstly, the heating step commences before all of the wash liquor has been introduced to the tub/drum. Hence the wash liquor starts to heat up before it is all present in the machine. Also, the heating step takes place over a longer period of time than in the previous embodiment. The first step of synchronized rotation commences at substantially the same time as the heating step. The first and second steps of synchronized rotation occur whilst the temperature of the wash liquor is increasing. As before, the first step of non-synchronized rotation helps to distribute wash liquor (water and detergent) throughout the wash load. Further, the first step of non-synchronized rotation and the subsequent step of synchronized rotation all occur as the temperature of the wash liquor continues to increase. The second step of non-synchronized rotation commences before the heating step is complete and the desired temperature is achieved during that step of non-synchronized rotation. Hence the average temperature of the wash liquor during that step of non-synchronized rotation is higher than the average temperature during the previous step of synchronized rotation. The efficacy of the non-synchronized rotation step is thereby improved.

The second step of non-synchronized rotation is followed as before by a draining step and several (in this case three) rinse and spin steps. When the final rinse and spin step has been completed, a short period of non-synchronized rotation occurs in order to remove the articles from the walls of the drum so as to minimise creasing.

A third embodiment of the method is illustrated in FIG. 3*c*. As in the method described in relation to FIG. 3*b*, the heating step commences before the all of the wash liquor has been introduced to the tub/drum. Only one period of synchronized rotation occurs before the first period of counter rotation, which distributes the wash liquor evenly throughout the load. Heating continues during the second period of synchronized rotation and also throughout the second period of non-synchronized rotation. The desired temperature is reached only at the end of the second period of non-synchronized rotation. Indeed, the duration of the second period of non-synchronized rotation can be determined by the time at which the desired temperature is achieved. In this example, four rinse and spin cycles are carried out, with the duration of the final spin being longer than that of the previous spin steps. Again, as with the previously described embodiments, a short period of non-synchronized rotation is carried out after the final spin in order to dislodge the articles from the wall of the drum in order to minimise creasing.

Having described the steps of each of the illustrated cycles, there now follows a table showing the preferred duration of the following steps in a number of preferred methods:

Step A: the period of synchronized rotation immediately preceding the first period of non-synchronized rotation;

Step B: the first period of non-synchronized rotation;

Step C: the period of synchronized rotation immediately following the first period of non-synchronized rotation;

Step D: the second period of non-synchronized rotation;

Step E: the final period of non-synchronized rotation.

| Cycle | Step A | Step B | Step C | Step D | Step E |
|---|---|---|---|---|---|
| Cycle 1 | 5 mins | 3 mins | 7 mins | 15 mins | <1 min |
| Cycle 2 | 5 mins | 3 mins | 10 mins | 37 mins | <1 min |
| Cycle 3 | 5 mins | 3 mins | 10 mins | 12 mins | <1 min |
| Cycle 4 | 5 mins | 3 mins | 25 mins | 12 mins | <1 min |
| Cycle 5 | 5 mins | 3 mins | 40 mins | 12 mins | <1 min |
| Cycle 6 | 5 mins | 3 mins | 25 mins | 30 mins | <1 min |
| Cycle 7 | 5 mins | 3 mins | 34 mins | 8 mins | <1 min |

It will be appreciated that the invention is not limited to the precise details of the embodiments described and discussed above. Modifications and variations falling within the scope of the claims will be apparent to a skilled reader. For the avoidance of doubt, it will be understood that details of standard components of the washing machine, eg. the means by which wash liquor is introduced to the washing machine, the wash liquor level is sensed, the water or wash liquor is drained, the programs are selected, the door locked and unlocked, etc, do not form part of the present invention and are therefore not described. Means to achieve the necessary and desired features will be readily apparent and available to a skilled reader.

What is claimed is:

1. A method of operating a laundry appliance comprising an outer casing and a drum rotatably mounted within the outer casing, the drum having at least two rotatable portions which are capable of being rotated in either a synchronized mode or a non-synchronized mode, the method comprising the steps of:

(a) introducing water to the interior of the drum;

(b) heating the water to a desired temperature;

(c) rotating the drum to effect a washing action; and (d) spinning the drum at a relatively high speed so as to remove water therefrom;

wherein the drum is rotated in the non-synchronized mode either during or immediately after the step of introducing water to the interior of the drum.

2. A method as claimed in claim 1, wherein the drum is not rotated in the non-synchronized mode until at least half of the water has been introduced into the interior of the drum.

3. A method as claimed in claim 2, wherein the drum is not rotated in the non-synchronized mode until at least three-quarters of the water has been introduced into the interior of the drum.

4. A method as claimed in claim 3, wherein the drum is not rotated in the non-synchronized mode until all of the water has been introduced into the interior of the drum.

5. A method as claimed in any one of the preceding claims, wherein the drum is rotated in the synchronized mode during the step of introducing water to the interior of the drum and prior to being rotated in the non-synchronized mode.

6. A method of operating a laundry appliance comprising an outer casing and a drum rotatably mounted within the outer casing, the drum having at least two rotatable portions which are capable of being rotated in either a synchronized mode or a non-synchronized mode, the method comprising the steps of:

(a) introducing water to the interior of the drum;

(b) heating the water to a desired temperature;

(c) rotating the drum to effect a washing action; and (d) spinning the drum at a relatively high speed so as to remove water therefrom;

wherein the drum is rotated in the synchronized mode during a first part of step (c) and in the non-synchronized mode during a second part of step (c), the average temperature of the water being no less during the second part of step (c) than the average temperature of the water during the first part of step (c).

7. A method as claimed in claim 6, wherein step (c) commences before step (b) has been completed.

8. A method as claimed in claim 7, wherein the second part of step (c) commences before step (b) has been completed.

9. A method as claimed in any one of claims 6 to 8, wherein the water reaches the desired temperature during the second part of step (c).

10. A method as claimed in claim 6 or 7, wherein the second part of step (c) commences after step (b) has been completed.

11. A method as claimed in claim 10, wherein the temperature of the water is the desired temperature during the whole of the second part of step (c).

12. A method as claimed in any one of claims 6 to 8, wherein the duration of the second part of step (c) is greater than the duration of the first part of step (c).

13. A method as claimed in any one of claims 6 to 8, wherein the duration of the second part of step (c) is at least twice the duration of the first part of step (c).

14. A method as claimed in any one of claims 6 to 8, wherein the duration of the second part of step (c) is at least three times the duration of the first part of step (c).

15. A method of operating a laundry appliance comprising an outer casing and a drum rotatably mounted within the outer casing, the drum having at least two rotatable portions which are capable of being rotated in either a synchronized mode or a non-synchronized mode, the method comprising the steps of:

(a) introducing water to the interior of the drum;

(b) heating the water to a desired temperature;

(c) rotating the drum to effect a washing action; and (d) spinning the drum at a relatively high speed so as to remove water therefrom;

wherein the drum is rotated in the non-synchronized mode after the end of step (d).

16. A method as claimed in claim 15, wherein step (d) is repeated at least once and the drum is rotated in the non-synchronized mode after the end of the final repeat of step (d).

17. A method as claimed in claim 15 or 16, wherein the duration of the rotation of the drum in the non-synchronized mode after the step (d) is less than one minute.

18. A method as claimed in claim 15 or 16, wherein step (b) commences before step (a) has been completed.

19. A method as claimed in claim 15 or 16, wherein the duration of step (c) is less than one hour.

20. A method as claimed in claim 15 or 16, wherein the duration of step (c) is substantially 55 minutes.

21. A method as claimed in claim 15 or 16, wherein the duration of step (c) is less than 40 minutes.

22. A method as claimed in claim 15 or 16, wherein the duration of step (c) is substantially 30 minutes.

23. A method as claimed in claim 15 or 16, wherein the duration of step (c) is less than 15 minutes.

24. A method as claimed in claim 15 or 16, wherein the duration of step (c) is substantially 14 minutes.

25. A method operating a laundry appliance comprising an outer casing and a drum rotatably mounted within the outer casing, the drum having at least two rotatable portions which are capable of being rotated in either a synchronized mode or a non-sychronized mode, the laundry appliance being programmed to operate in accordance with a method according to claim 1, 6 or 15.

* * * * *